US006223779B1

(12) United States Patent
Speich

(10) Patent No.: US 6,223,779 B1
(45) Date of Patent: May 1, 2001

(54) AUXILIARY SELVAGE FORMING AND WEFT THREAD CUTTING DEVICE

(75) Inventor: Francisco Speich, Gipf-Oberfrick (CH)

(73) Assignee: Textilma AG, Hergiswil (CH)

( * ) Notice: Subject to any disclaimer, the term of this patent is extended or adjusted under 35 U.S.C. 154(b) by 0 days.

(21) Appl. No.: 09/402,436

(22) PCT Filed: Apr. 9, 1997

(86) PCT No.: PCT/CH97/00141

§ 371 Date: Oct. 7, 1999

§ 102(e) Date: Oct. 7, 1999

(87) PCT Pub. No.: WO98/45517

PCT Pub. Date: Oct. 15, 1998

(51) Int. Cl.[7] ..... D03D 47/34; D03D 47/30
(52) U.S. Cl. ..... 139/302; 139/435.6
(58) Field of Search ..... 139/302, 435.6, 139/291 C

(56) References Cited

U.S. PATENT DOCUMENTS

| | | | | |
|---|---|---|---|---|
| 4,572,246 | * | 2/1986 | Ghiaro | 139/435 |
| 4,905,741 | * | 3/1990 | Wahhoud et al. | 139/302 |
| 5,649,570 | * | 7/1997 | Wahhoud et al. | 139/302 |

FOREIGN PATENT DOCUMENTS

| | | |
|---|---|---|
| 390826 | 8/1965 | (CH) . |
| 3204007 | 8/1993 | (DE) . |
| 0120429 | 10/1984 | (EP) . |
| 0160117 | 11/1985 | (EP) . |
| 0203256 | 12/1986 | (EP) . |
| 0284766 | 10/1988 | (EP) . |
| 0318802 | 7/1989 | (EP) . |
| 0393468 | 10/1990 | (EP) . |
| 2047286 | 11/1980 | (GB) . |
| 32221 | 12/1979 | (TW) . |
| 44598 | 6/1982 | (TW) . |
| 109730 | 3/1989 | (TW) . |
| 9713901 | 4/1997 | (WO) . |

* cited by examiner

*Primary Examiner*—Andy Falik
(74) *Attorney, Agent, or Firm*—Brown & Wood, LLP

(57) ABSTRACT

A loom with pneumatic weft thread insertion and including a reed, a weft thread guide device connected with the reed and pivotable therewith between an insertion position and a beat-up position, a stationary weft insertion device having at least one blowing nozzle for inserting a weft thread into a guide channel of the weft thread guide device, an arrangement for forming a selvage having edge threads for clamping the weft thread after termination of the weft thread insertion and for guiding the weft thread from the insertion position to the beat-up position, and a shear having a first, stationary blade secured to a loom frame and a second, movable blade movement mounted on the reed for joint movement therewith and which cooperates with the first, stationary blade for cutting off a clamped weft thread in a region of a rear position of the reed outside of the selvage.

10 Claims, 8 Drawing Sheets

AUXILIARY SELVAGE FORMING AND WEFT THREAD CUTTING DEVICE

BACKGROUND OF THE INVENTION

1. Field of the Invention

The invention relates to a loom with pneumatic weft thread insertion.

2. Description of the Prior Art

Looms with pneumatic weft thread insertion are known from the prior art in which the weft insertion is carried out either by means of a pivotable insertion device mounted on the reed or by means of an insertion device of fixed position mounted on the machine frame.

The looms with a pivotable insertion device have disadvantages. The respectively inserted weft thread is clamped in the region of the reed beat-up and cut so that the setting of the blowing nozzles in the insertion position can only take place during the resetting of the reed which in particular restricts the number of blowing nozzles and moreover makes a special control necessary. Through the to and fro movement of the reed provided with the insertion device relatively high inertial forces are produced which lead to undesired oscillations of the moved system and the weft threads are set in uncontrolled oscillations during this supply from the thread feeder into the blowing nozzles so that they cross one another and become caught up with one another. The air lines and the actuating apparatus are subjected to high mechanical loading which in particular makes a complicated control necessary for the actuating apparatus. From these disadvantages, lower speeds of rotation of the loom follow as a result of a higher tendency to break down, which is associated with a loss of productivity. Furthermore, it has proved to be disadvantageous that a shear is mounted on the machine frame and actuated via separate drive means, which has the consequence of a greater complexity apparatus-wise. The use of a thread clamp with active clamping, in which at least one clamping member is actively actuated, represents a further disadvantage. Thread breakages increasingly occur, in particular with fine threads.

The invention is based on the object of so improving a loom with pneumatic weft insertion that the named disadvantages do not occur.

SUMMARY OF THE INVENTION

This object is satisfied in accordance with the invention with a loom including a reed and weft thread guide device, which are connected to one another, and pivotable between an insertion position and a beat-up position, a stationary weft insertion device with at least one blowing nozzle for the insertion of a weft thread into the guide channel, and a shear, with means for the formation of the selvage for clamping the weft thread, after the termination of the weft insertion, with edge threads under fictional engagement and to guide it from the insertion position to the beat-up position while maintaining the clamping action, and wherein the shear is associated with the reed for cutting off the clamped weft thread after the termination of the weft insertion in the region of the rear position of the reed outside of the selvage. The advantages which can be achieved with the invention are essentially to be seen in the fact that up to sixteen weft threads of different kinds and also color can be used and that the loom can be operated at a high speed of rotation.

The invention will be explained in the following with reference to the accompanying drawings. There are shown:

DETAILED DESCRIPTION OF THE PREFERRED EMBODIMENT

Figure 8:
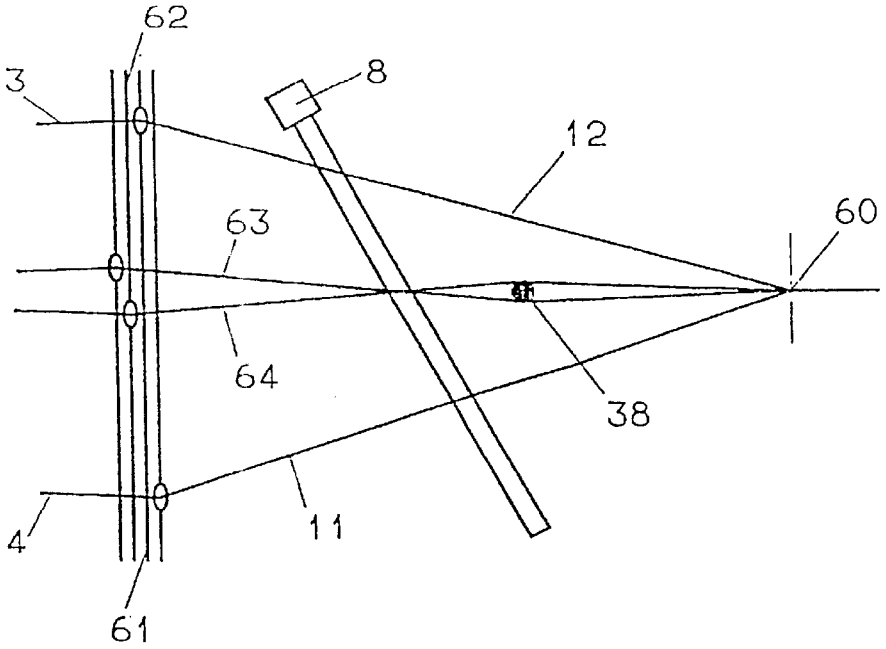
FIG. 8 a schematic representation of the shed positions after conclusion of the weft insertion, FIG. 9 a section along the line IX—IX in FIG. 2 which represents the situation during the weft thread insertion, FIG. 10 the section of FIG. 9 which shows the situation during the clamping of the weft thread, FIG. 11 the section of FIG. 9 which shows the situation during cutting of the weft thread, FIG. 12 the section of FIG. 9 which shows the situation during beat-up of the reed, and FIG. 13 another embodiment of a shear.

The loom under discussion here contains a machine frame 1, a warp beam 2 from which warp threads 3, 4 are let out, a whip roll 5, a shed forming apparatus 6 with a means for the formation of the selvage, an arrangement 7 for the insertion of weft threads, a reed 8, a cloth take-up 9 and a cloth-beam 10. The shed forming device 6 forms via heddles an upper an a lower shed 11, 12 with the warp threads 3, 4 and also a shed with the edge threads (FIG. 8).

Figure 1:
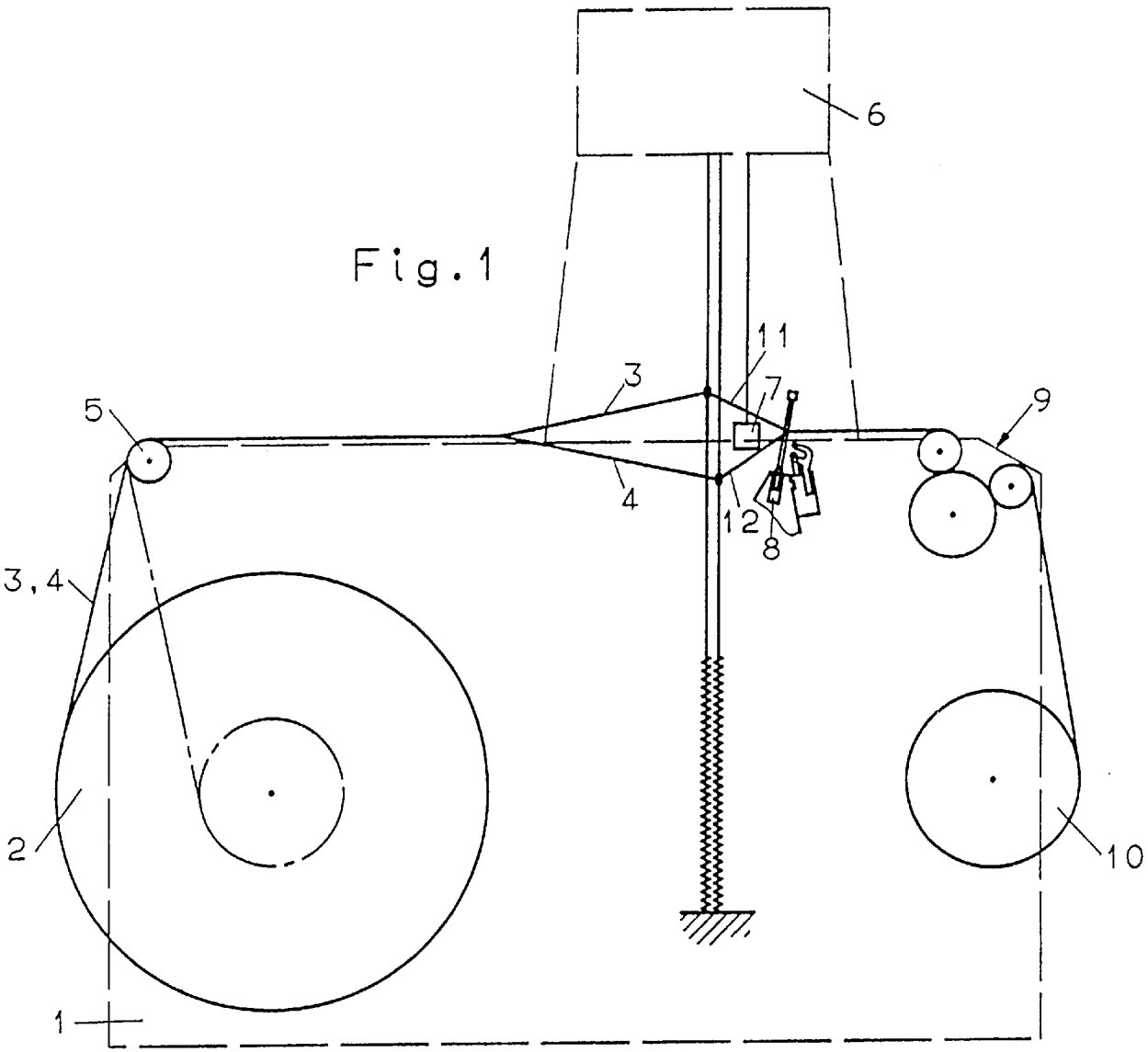
FIG. 1 an embodiment of a loom in accordance with the invention with air insertion in schematic representation, FIG. 2 a side view of the weft insertion region of the loom shown in section, FIG. 3 a section along the line III—III in FIG. 2, FIG. 4 a section along the line IV—IV in FIG. 2, FIG. 5 a section along the line V—V in FIG. 2, FIG. 6 a section along the line VI—VI in FIG. 2, FIG. 7 an embodiment of a control apparatus for the blowing nozzles.
Figure 2:
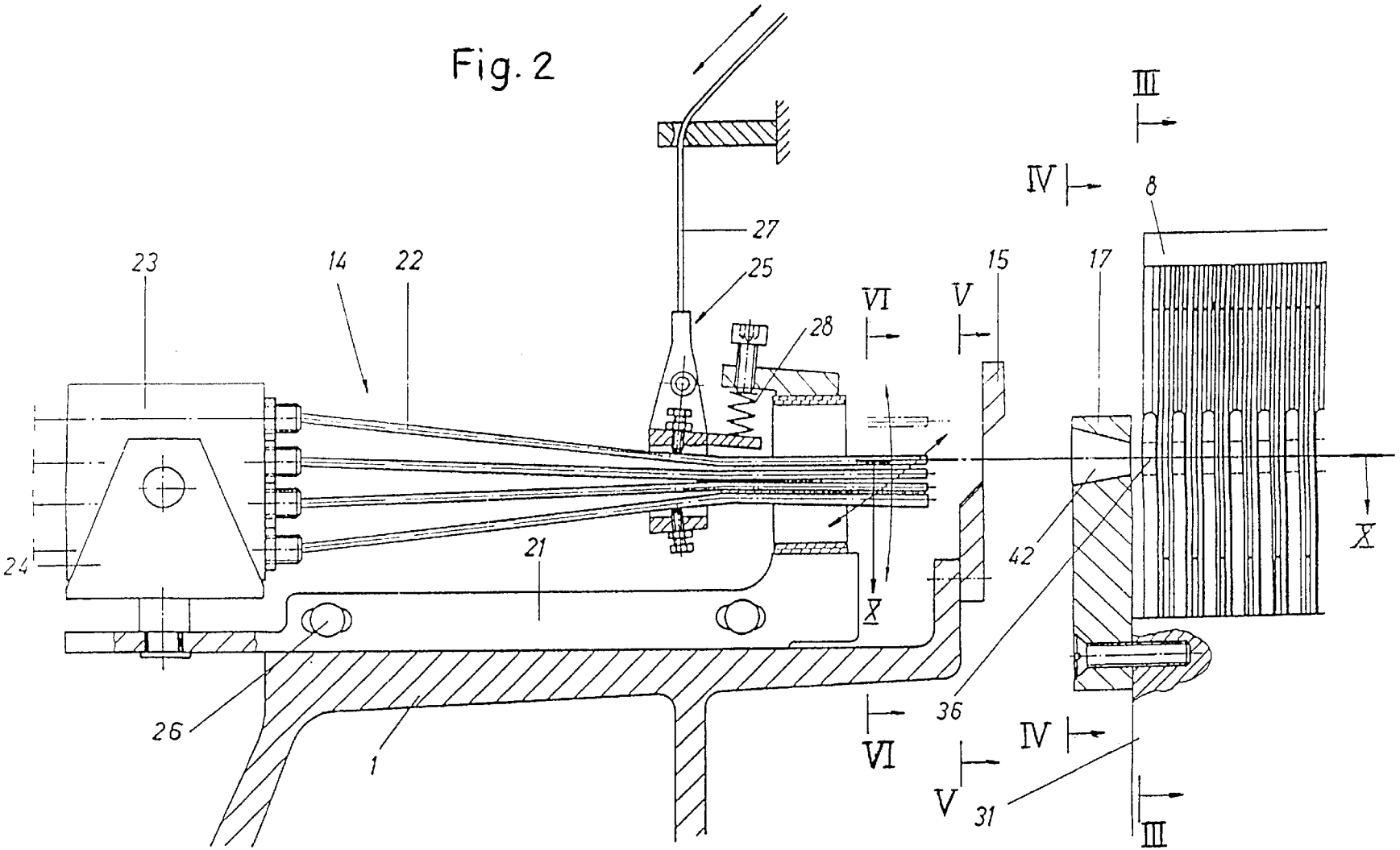

As FIG. 2 shows the arrangement 7 contains a pneumatic weft insertion device 14 and also a shear 15 and a blow-in aid 17 which are arranged in the thread running direction between the insertion device 14 and the reed 8. The insertion device 14 is mounted on the machine frame 1. The shear 15 is coupled to the reed 8. The blow-in aid 17 is connected to the reed 8. The insertion device 14 contains a carrier part 21, eight blowing nozzles 22, a nozzle block 23, a holder 24 and an actuating device 25. The carrying part 21 is secured by means of screws 26 to the machine frame 1. The blowing nozzles 22 are arranged pair-wise and stand in operative connection with a source of compressed air and a weft thread store. The blowing nozzles 22 are releasably mounted in the nozzle block 23 at one end. The holder 24 for the nozzle block is connected to the carrier part 21. The actuating device 25 is connected via a kinematic member 27 to the shed forming apparatus 6 in order to position the blowing nozzles 22 in the weft insertion position. For this purpose the nozzle block 23 and the holder 24 are so designed that the openings of the blowing nozzles are pivotable about two directions extending perpendicular to one another. A spring 28 is provided which keeps the kinematic member 27 under load. It is pointed out that a drive arrangement can be provided instead of the actuating device 25 and can be controlled via a control device known per se in order to position the blowing nozzles in the insertion position.

Figure 3:
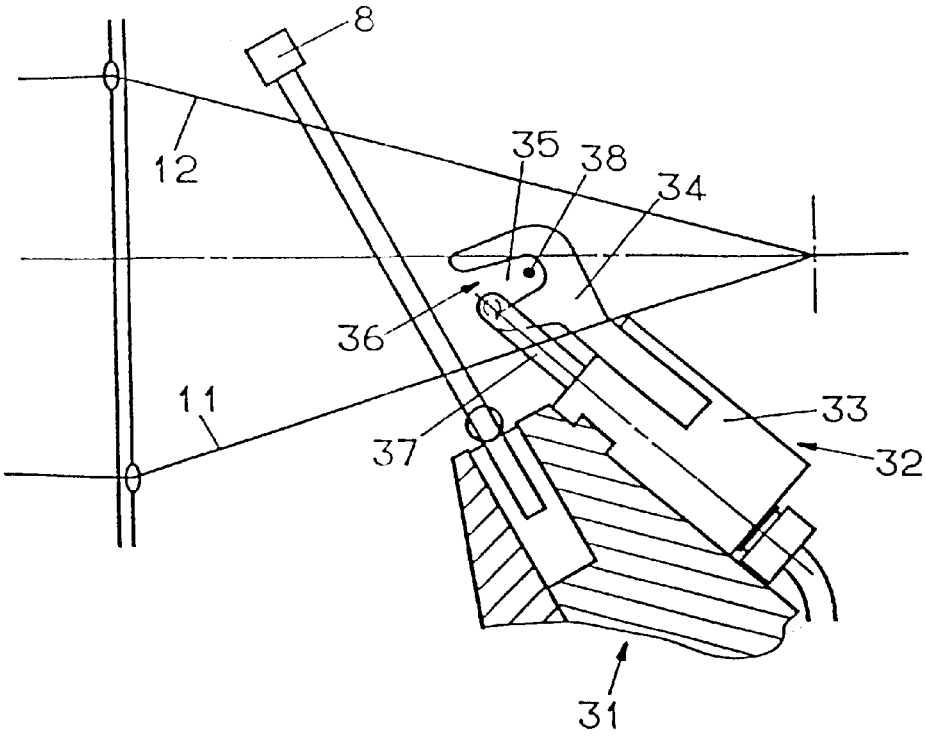

As FIG. 3 shows the reed 8 is mounted on a reed sley 31. A thread guide device 32 is secured to the reed sley. It is of advantage when the guide device 32 includes an air guiding part 33 which is mounted on the reed sley, a plurality of lamella 34 which are arranged in comb-like manner and are each provided with a recess 35 in order to define a guide channel 36 and relay nozzles 37 in order to convey the inserted weft thread 38 through the guide channel. Instead of the thread guiding apparatus 32 a so-called tunnel reed with relay nozzles can be used.

Figure 4:
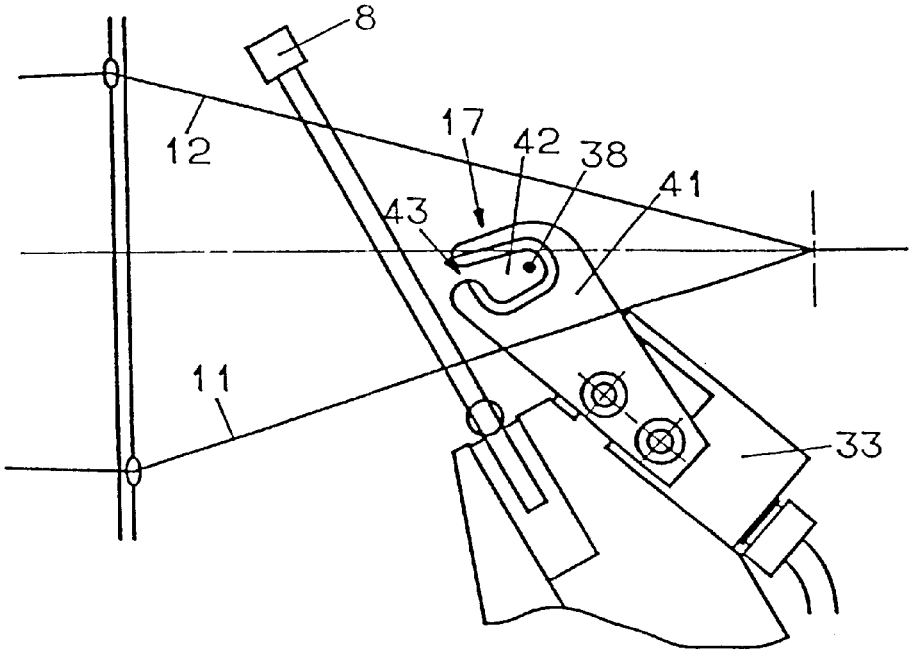

In the loom under discussion here the blow-in aid 17 is used with advantage. The blow-in aid is a plate-like body 41 with a conical penetration 42 and an outlet slot 43. The body 41 is secured to the air guiding part 33. It is however possible to form the first lamella 34 as a blow-in aid (FIG. 4).

Figure 5:
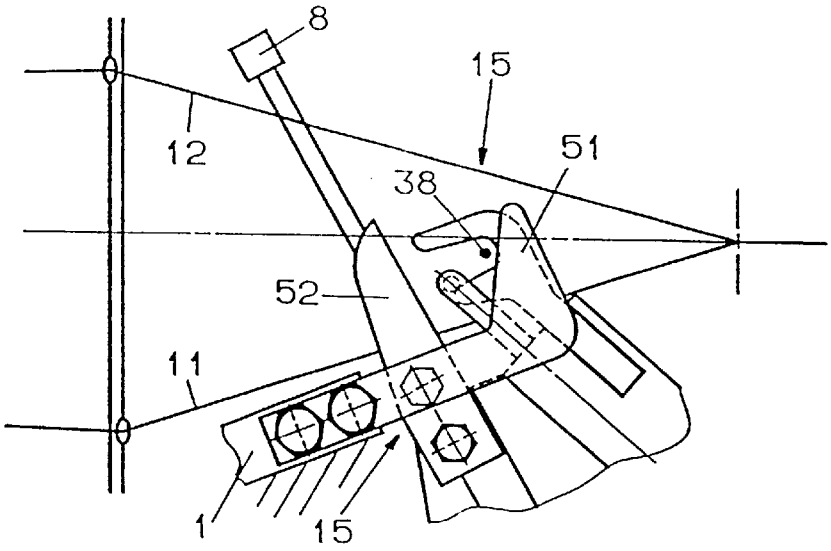

The shear 15 has one spatially fixed and one movable shear blade 51, 52. The spatially fixed shear blade 51 is secured to the machine frame 1. The movable shear blade 52 is mounted on the reed 8 (FIG. 5) for joint movement therewith.

Figure 6:
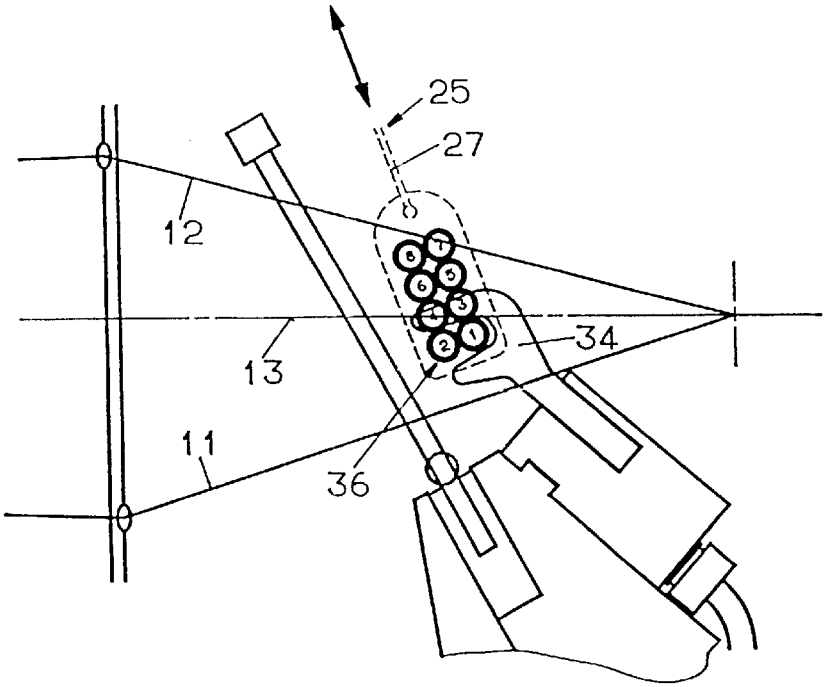

FIG. 6 shows the association of the blowing nozzles to the guide channel 36 defined by the lamella 34. An important feature of the loom lies in the fact that the respective pair of blowing nozzles is aligned substantially parallel to the center line of the guide channel 36 when the guide channel adopts the insertion position. The setting of the blowing nozzles 22 takes place through the actuating device 25 and the kinematic member 27. As an alternative to this the blowing nozzles 12 can be arranged in bundle-like manner.

Figure 7:
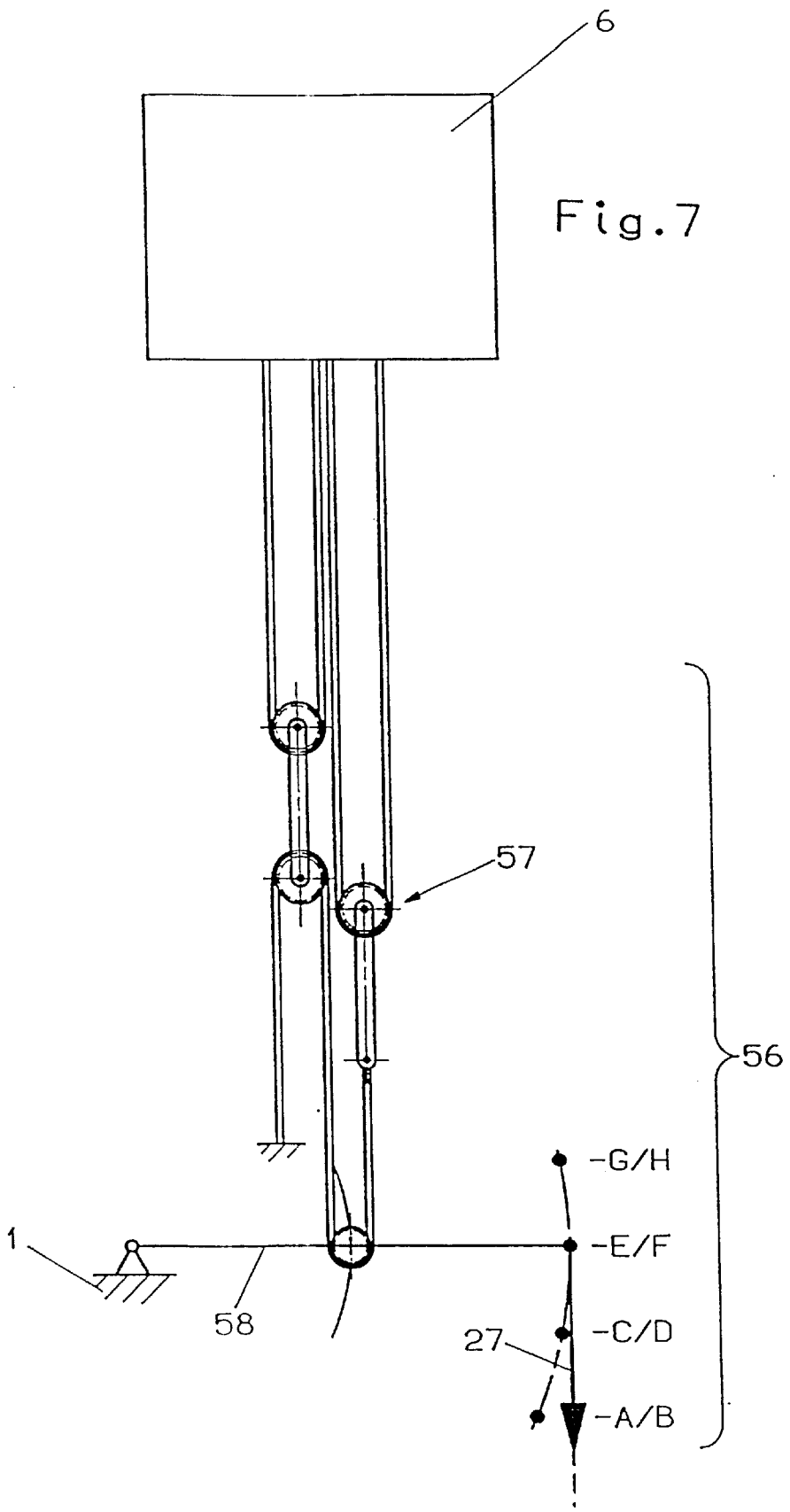

As FIG. 7 shows, the shed forming device 6 includes for example a jaquard apparatus or dobby, a colour control apparatus 56, a summing transmission 57 and a one-arm lever 58 which is pivotally connected to the machine frame 1. Such summing transmissions and their function are known, so that a description of the same can be dispensed with. The kinematic member 27 is secured to the lever 58 which is connected to the actuating device 25.

In the following the insertion procedure is described with reference to the FIGS. 8 to 12. In looms one weft thread is inserted per revolution of the main drive shaft of the loom and is beaten up against the cloth edge 60. The control of the individual elements of the loom is derived from this machine cycle. In the above described loom the drive of the reed 8 is controlled in general and in relation to the weft insertion only the setting of the blowing nozzle 22 to the insertion position and the insertion of the weft thread 38 are controlled in dependence on the angle of rotation of the main shaft.

Figure 10:
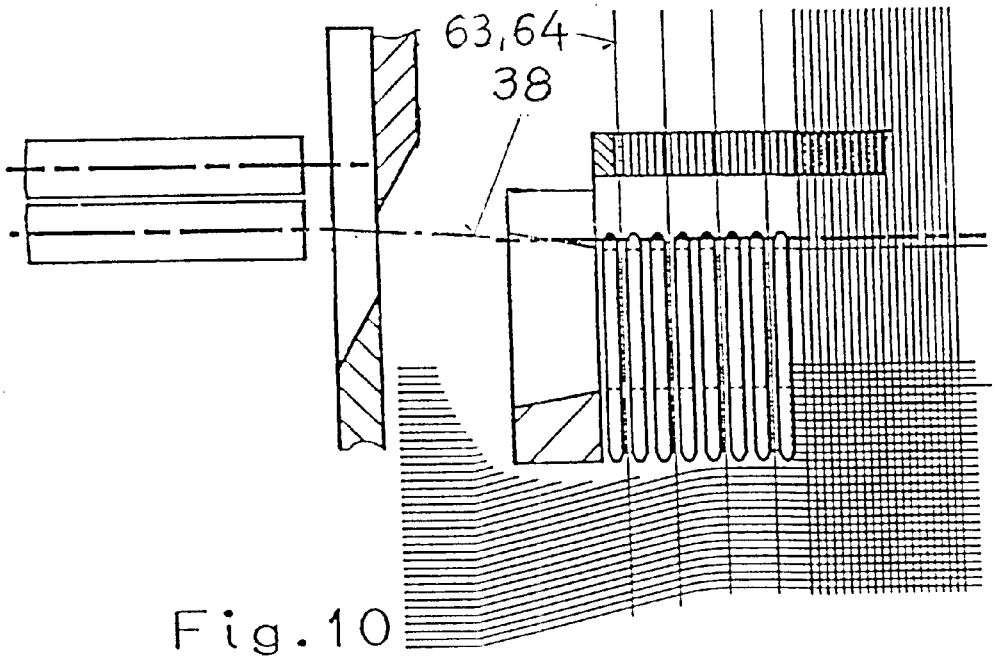

The FIG. 8 shows the clamping procedure of the inserted weft thread by means of the apparatus for the selvage formation, wherein the weft thread extends, starting from the blowing nozzle 36 (not shown) through the shed. This apparatus is so designed that on the one hand a shed is formed by means of the edge threads 63, 64 moved by the headle 61, 62 and on the other hand the shed change is introduced directly after the conclusion of the insertion process of the weft thread. As a result of this shed change the inserted weft threads 38 are clamped frictionally by means of the edge threads 63, 64. This frictional clamping is maintained in advantageous manner up to the beat-up of the weft thread 38 by means of the edge threads 63, 64. At the time of cutting of the weft thread the latter is already frictionally clamped so that the cut weft thread no longer releases itself (FIG. 10).

Figure 9:
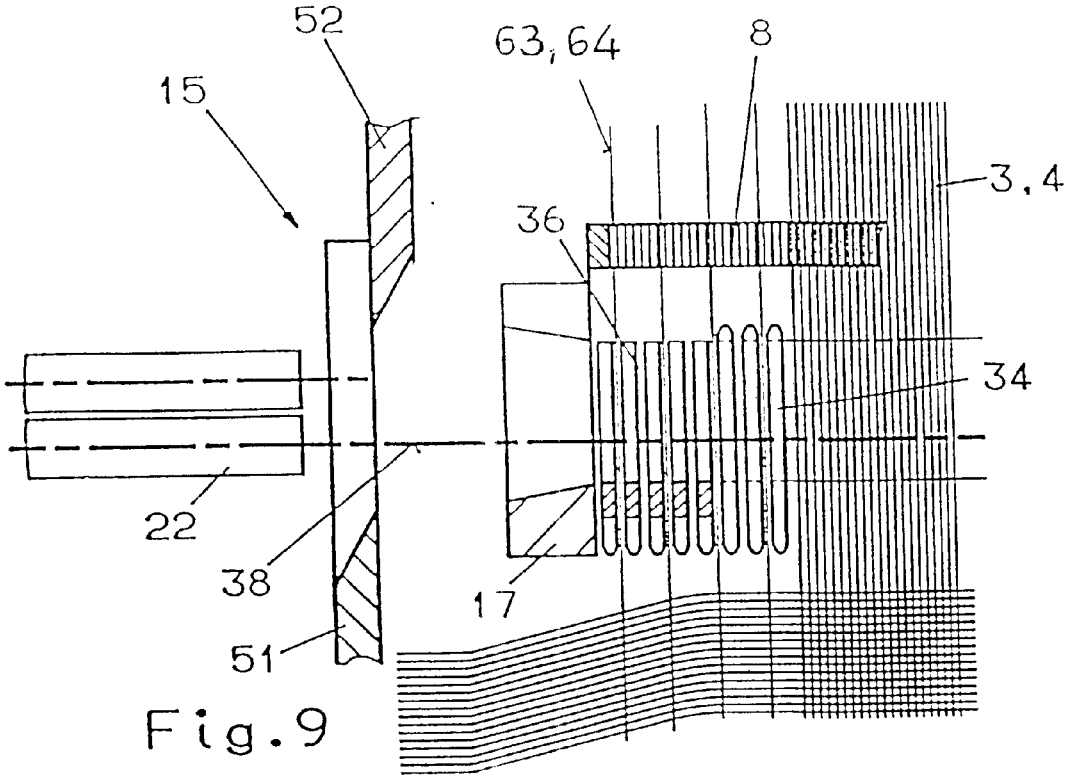

The FIG. 9 shows the situation during the insertion of a weft thread 38. The blowing nozzle 22 is placed in the insertion position. The reed 8 stands in the retractive position, the shear 15 is located in the open position and the weft thread is shot in through the blow-in aid 17 and through the edge thread 63, 64 into the guide channel 36 of the thread guiding device 32.

After the weft thread 38 has been inserted into the guide channel 36 the shed change of the edge thread 63, 64 is carried out in accordance with the machine cycle and the weft thread 38 is frictionally clamped (FIG. 10) by the warp threads. Furthermore, the reed 8 is pivoted in the direction towards the beat-up position.

Figure 11:
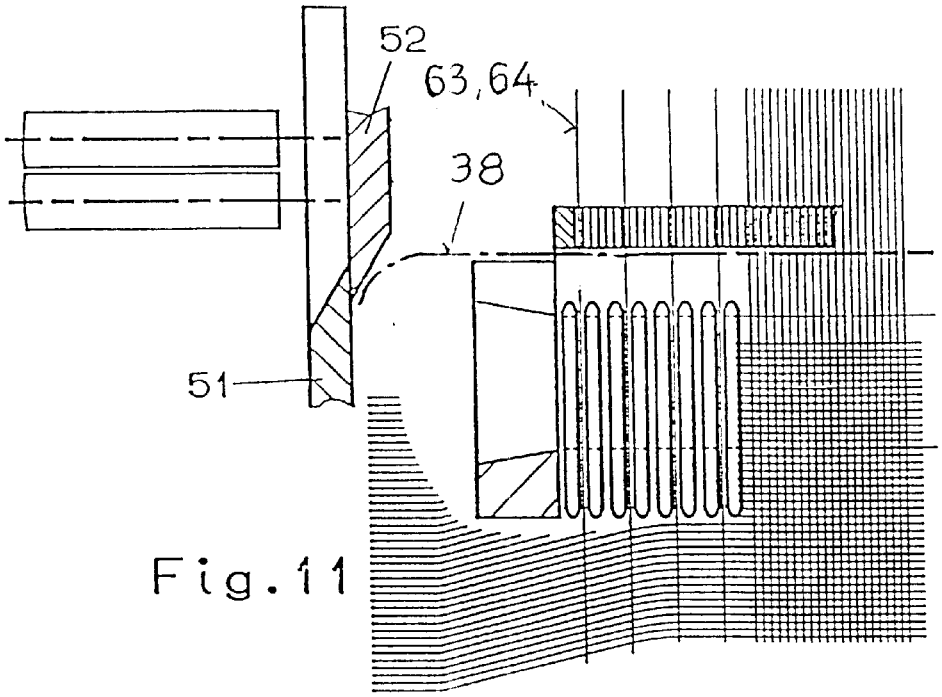

After the clamping the weft thread 38 is cut off because the shear blade 52 connected to the reed 8 is moved towards the fixed shear blade 51. The cutting off of the clamped weft thread takes place in the region of the rear position of the reed 8 outside of the selvage. In this way a new weft thread is made available for the insertion. Furthermore, the weft thread 38 is displaced by the reed 8 (FIG. 11).

Figure 12:
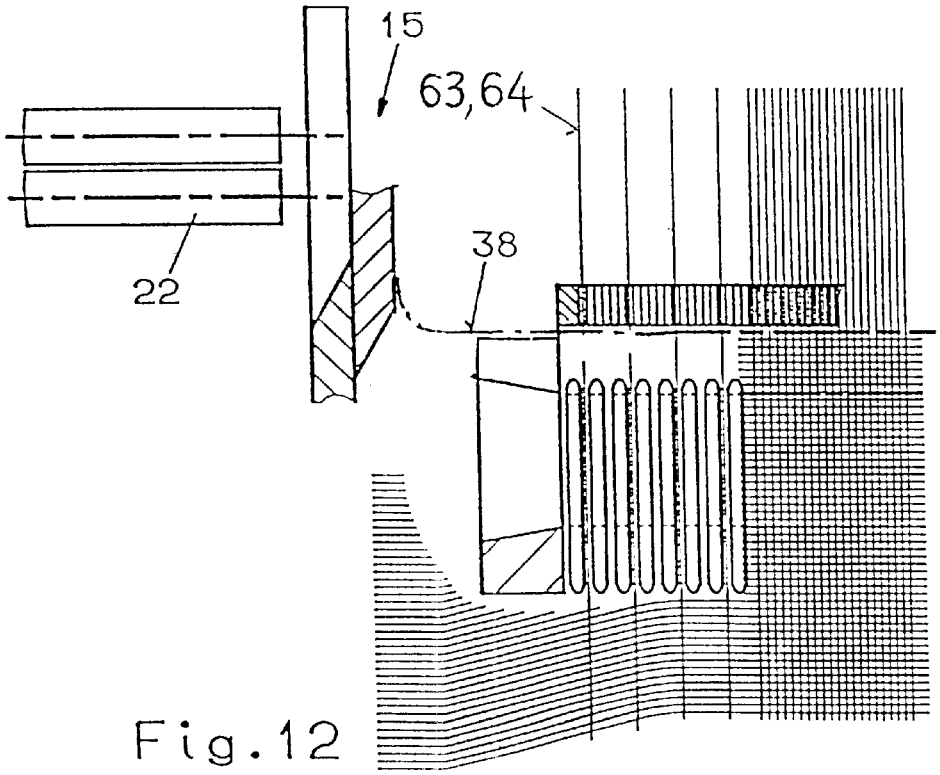

Thereafter the reed 8 reaches the beat-up position with the weft thread 38 being beaten up against the previously beaten up weft thread which has already been tied off by the shed change. Thereafter the reed 8 is pivoted into the retracted position (FIG. 12).

Figure 13:
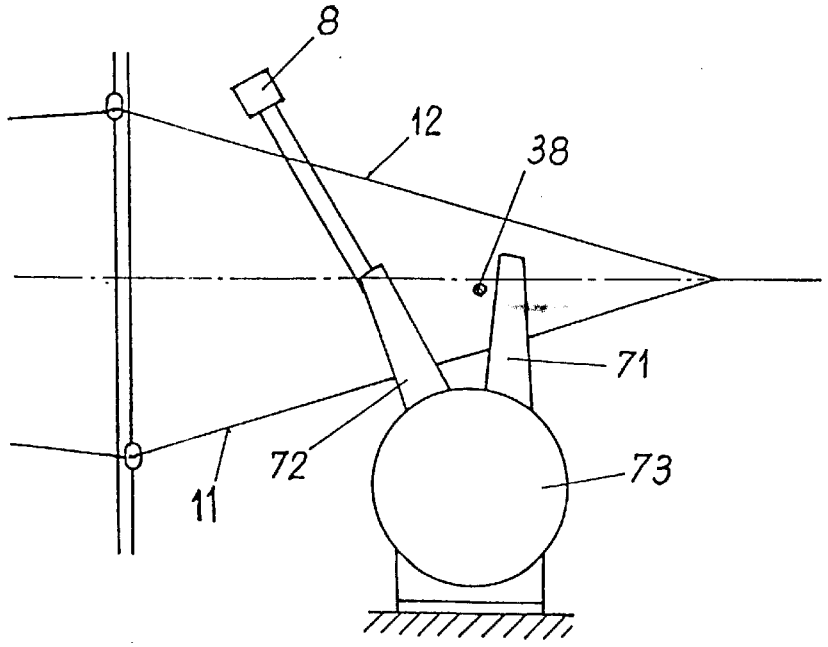

FIG. 13 shows another embodiment of the shear 15. The shear has now as previously a fixed shear blade 71 and a movable shear blade 72 which is pivotable relative to the fixed shear blade. An electric stepping motor 73 is provided for the actuation of the movable shear blade .

In the above described loom the weft thread 38 is thus inserted by the weft insertion device 14 of fixed position into the guide channel 36 and is held, cut and beaten up during the pivoting of the reed 8. From this a series of advantages result. Through the spatially fixed insertion apparatus the supply of the weft thread from a weft thread store is more reliable and the time period for the setting of the blowing nozzle into the insertion position is substantially extended, so that up to sixteen weft threads of different color and also type can be inserted. Through the frictional clamping and the movement of the inserted weft thread with the reed up to the beat-up a problem-free beating up of the weft thread is insured, with the projecting weft thread end sections being short and little waste occurring.

What is claimed is:

1. Loom with pneumatic weft thread insertion, comprising a reed; a weft thread guide device connected with the reed and pivotable therewith between an insertion position and a beat-up position; a stationary weft insertion device having at least one blowing nozzle for inserting a weft thread into a guide channel of the weft thread guide device; means for forming a selvage having edge threads for clamping the weft thread after termination of the weft thread insertion of guiding the weft thread from the insertion position to the beat-up position; and a shear having a first, stationary blade secured to a loom frame and a second, movable blade mounted on the reed for joint movement therewith and which cooperates with the first, stationary blade for cutting off a clamped weft thread in a region of a rear position of the reed outside of the selvage.

2. Loom in accordance with claim 1, further comprising a blow-in aid (17), wherein the shear (15) and the blow-in aid (17) are arranged behind one another in a thread running direction between a mouth of the blowing nozzle (22) and the guide channel (36).

3. Loom in accordance with claim 2, wherein the blow-in aid (17) is arranged in a fixed position.

4. Loom in accordance with claim 3, wherein the blow-in aid (17) has a conical penetration (42) a largest width of which confronts the opening of the blow nozzle (22) and which has an outlet slot (43) for the weft thread (38).

5. Loom in accordance with claim 1, wherein the insertion device (14) is mounted on a loom frame (1).

6. Loom in accordance with claim 1, wherein an actuating device (25) is provided for positioning the blowing nozzle (22) in the insertion position in accordance with a weaving pattern program.

7. Loom in accordance with claim 1, wherein the movable blade is connected with one of the reed and separate drive means.

8. Loom in accordance with claim 7, wherein the drive means is an electric motor.

9. Loom in accordance with claim 1, wherein the insertion device has a plurality of blowing nozzles (22), and wherein the loom further comprises means for effecting one of moving the blowing nozzles (22) up and down and pivoting the blowing nozzle about axes which cross each other.

10. Loom in accordance with claim 1, wherein the insertion device has a plurality of blowing nozzles (22), and wherein the loom further comprises means for supporting the blowing nozzles (22) in a condition in which the blowing nozzles are one of arrange pair-wise above one another and form a bundle.

* * * * *